US005660285A

United States Patent [19]

Tooma

[11] Patent Number: 5,660,285

[45] Date of Patent: Aug. 26, 1997

[54] TOOTHBRUSH HOLDER

[76] Inventor: William Tooma, 41 Allan Dr., North Arlington, N.J. 07031

[21] Appl. No.: 420,228

[22] Filed: Apr. 11, 1995

[51] Int. Cl.[6] ..... A47B 81/02

[52] U.S. Cl. ..... 211/65; 206/362; 220/337; 220/339; D6/528; D6/534

[58] Field of Search ..... 211/65, 66, 87; 248/110; 206/361, 362, 362.1, 362.2, 362.3, 368, 369; 220/337, 339; D6/528, 534

[56] References Cited

U.S. PATENT DOCUMENTS

| | | | |
|---|---|---|---|
| D. 183,987 | 11/1958 | Jones | D6/528 |
| D. 207,630 | 5/1967 | Jones | D6/528 |
| D. 234,036 | 1/1975 | Nixon | D6/528 |
| D. 234,481 | 3/1975 | McLeod | D6/534 |
| 2,592,131 | 4/1952 | Farrar | D6/534 X |
| 3,746,162 | 7/1973 | Bridges | D6/534 X |
| 4,880,020 | 11/1989 | Schurgin | 206/362.3 X |
| 4,964,683 | 10/1990 | Sugarek et al. | D6/528 X |
| 5,375,711 | 12/1994 | Bree et al. | 206/361 X |
| 5,377,824 | 1/1995 | Seymour | 206/362.1 X |
| 5,522,497 | 6/1996 | Stacy | 206/362.1 X |

*Primary Examiner*—Leslie A. Braun
*Assistant Examiner*—Richard M. Smith
*Attorney, Agent, or Firm*—McAulay Fisher Nissen Goldberg & Kiel, LLP

[57] ABSTRACT

A toothbrush holder device comprises a generally cup-shaped support member and a lid member. The support member is provided with at least one aperture traversable by a toothbrush handle and is further provided with a hole spaced from the aperture for enabling drainage of fluid from the support member. The lid member is hinged to the support member so as to be shiftable between a closure position covering the support member and a toothbrush head on the support member and an opened position providing access to the support member and a toothbrush supported thereby.

5 Claims, 5 Drawing Sheets

TOOTHBRUSH HOLDER

BACKGROUND OF THE INVENTION

This invention relates to a toothbrush holder.

In the home and in public accommodations such as hotels, toothbrushes are generally stored on holders having apertures or recesses for receiving the the handles of the brushes. The bristles of the toothbrush heads rest on the upper surfaces of the supports. This conventional structure gives rise to a significant potential for disease transmission, particularly in hotels and other public guest facilities, unless special attention is paid to cleaning and sterilizing the toothbrush holders.

Another characteristic of conventional toothbrush holders is that the toothbrushes are exposed and therefore capable of acquiring microorganisms from mouth spray which is incidental to tooth cleaning.

OBJECTS OF THE INVENTION

An object of the present invention is to provide a toothbrush holder which reduces the chances of disease transmission.

Another object of the present invention is to provide such a toothbrush holder which is disposable.

Another, related, object of the present invention is to provide such a toothbrush holder which is inexpensive.

A further object of the present invention is to provide such a toothbrush holder which protects the brush and reduces, if not eliminates, the chances of acquisition of air-borne microorganisms.

Yet another object of the present invention is to provide a toothbrush holder which can be carried with the toothbrush during travel.

These and other objects of the present invention will be apparent from the drawings and detailed descriptions herein.

SUMMARY OF THE INVENTION

A toothbrush holder device comprises, in accordance with the present invention, a generally cup-shaped support member and a lid member. The support member is provided with at least one aperture traversable by a toothbrush handle and is further provided with structure for enabling drainage of fluid from the support member. The lid member is movably attached to the support member so as to be shiftable between a closure position covering the support member and a toothbrush head on the support member and an opened position providing access to the support member and a toothbrush supported thereby.

Generally, it is contemplated that the drainage structure is different and spaced from the toothbrush receiving aperture. More specifically, the drainage structure may include a hole provided in a lowermost part of the support member, the hole being spaced from the aperture.

The aperture may be one of a plurality of apertures provided in the support member for receiving respective toothbrush handles. In that case, each of the apertures is radially spaced from the drainage hole and angularly spaced from the other apertures about an axis of the support member.

According to further features of the present invention, the apertures are substantially rectangular, while the lid member is also cup-shaped.

The lid member and the support member may approximate spherical sections.

According to another feature of the present invention, the lid member is hingedly secured to the support member. Locking elements such as a snap-lock detent or latch may be provided on the support member and/or the lid member for releasably locking the lid member to the support member.

According to an ancillary feature of the present invention, the toothbrush holder device further comprises an element on the support member for attaching the support member to a stationary fixture.

A toothbrush holder in accordance with the present invention reduces the chances of disease transmission. The lid serves to create an enclosure for the toothbrush bristles, thereby shielding the bristles from air-borne microorganisms and cleaning products. The toothbrush holder is utilizable in the home, as well as in public facilities such as resorts, commercial hotels, luxury liners, hospitals, and other medical and health institutions.

Because a toothbrush holder in accordance with the present invention is disposable, the entire holder may be removed from a bathroom fixture for replacement by a new, sterile, holder. This feature is particularly advantageous in maintaining the cleanliness of public accommodations. As an added advantage, the hotel customer may take the toothbrush holder along upon vacating a room. The holder can be carried in a purse or overnight bag, with the toothbrush stored inside the enclosure defined by the support member and the lid. This protects both the toothbrush and the other contents of the purse or bag from cross-contamination.

A toothbrush holder in accordance with the present invention is simple to manufacture and accordingly inexpensive. The various components of the device may be of injection molded polymeric material. After use, the material may be sterilized and recycled.

DETAILED DESCRIPTION

Figure 1:
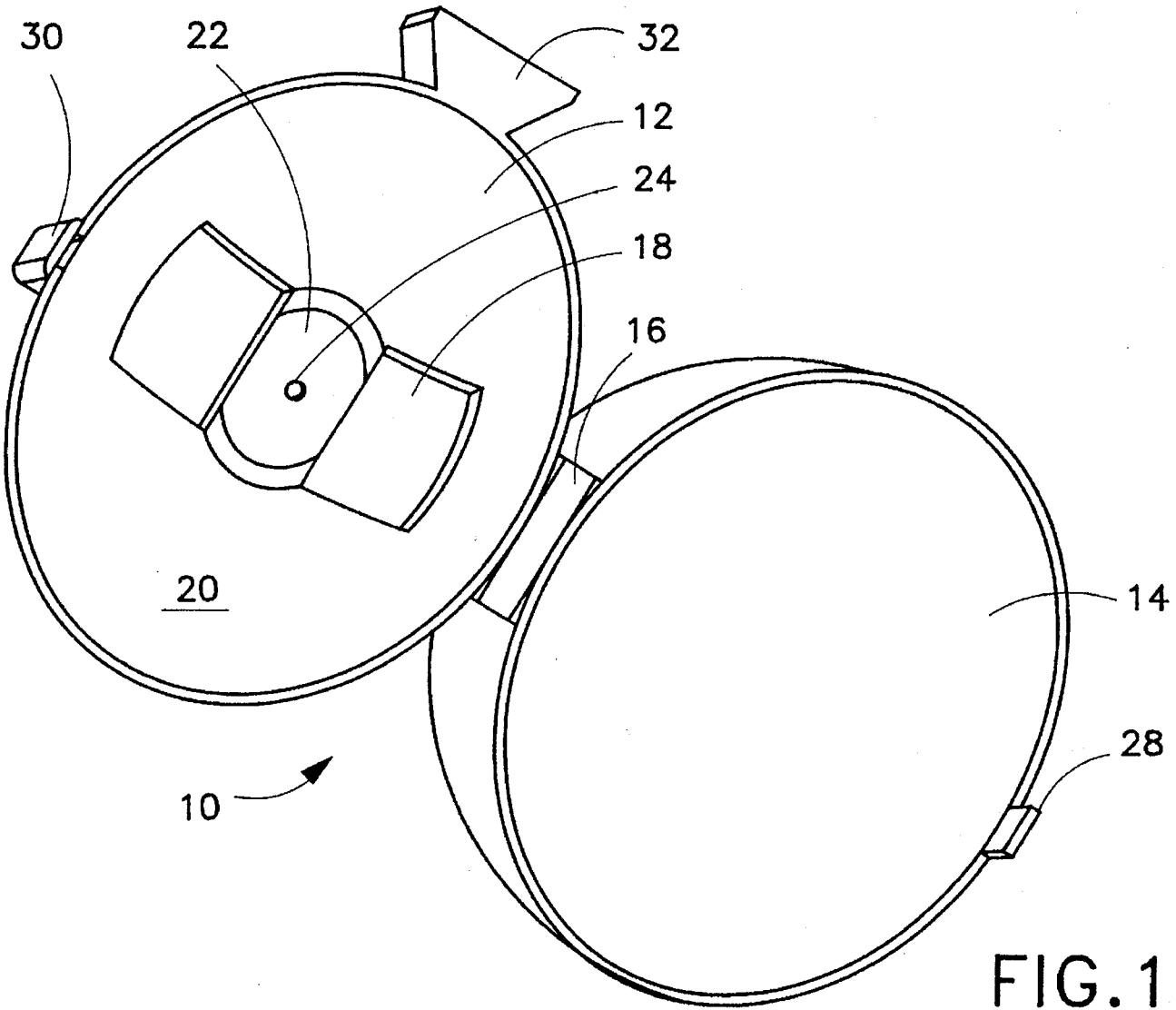
FIG. 1 is a top, front, and right side perspective view of a toothbrush holder in accordance with the present invention, showing the toothbrush holder in an opened configuration.
Figure 2:
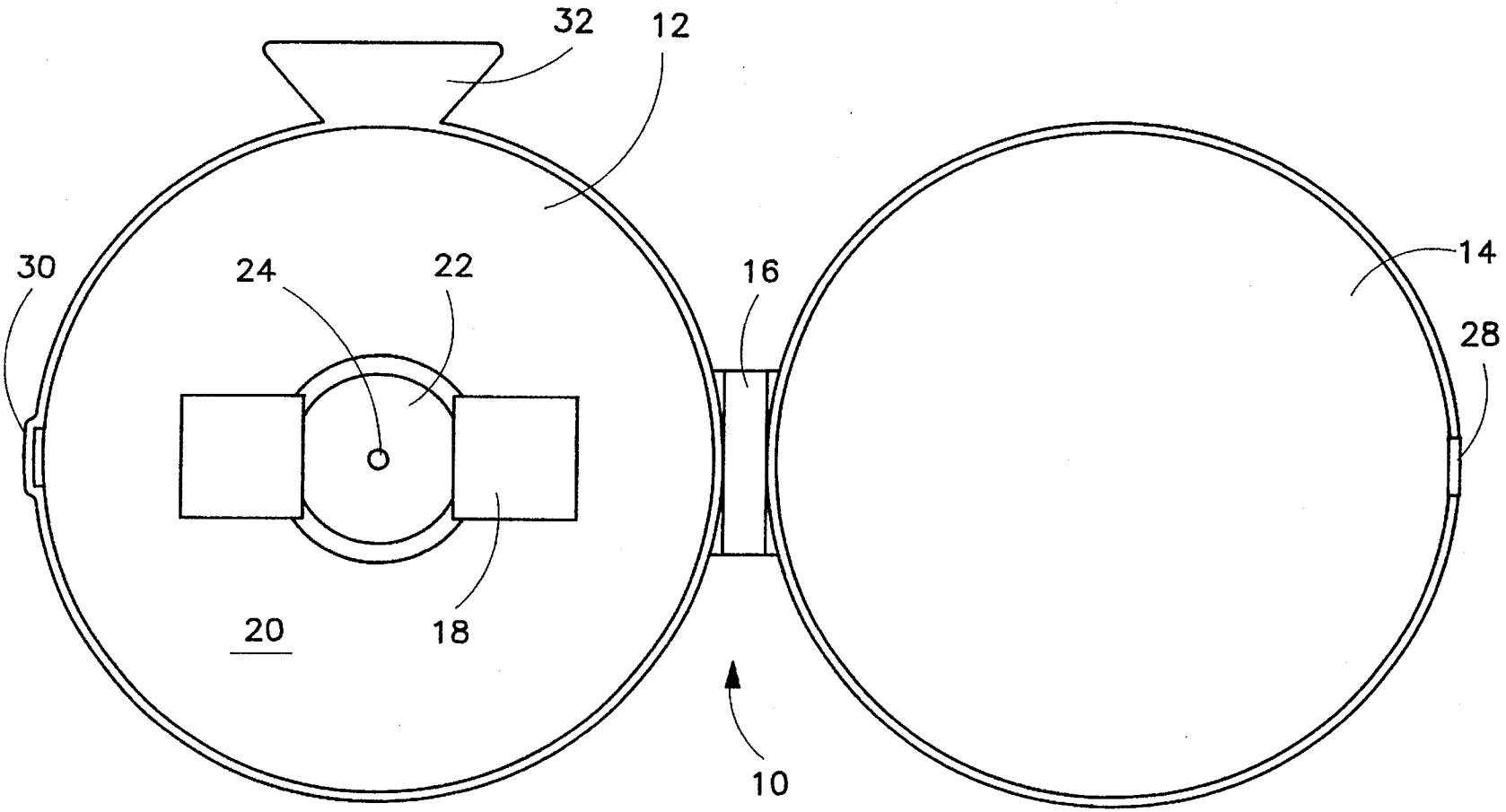
FIG. 2 is a top plan view thereof.
Figure 3:
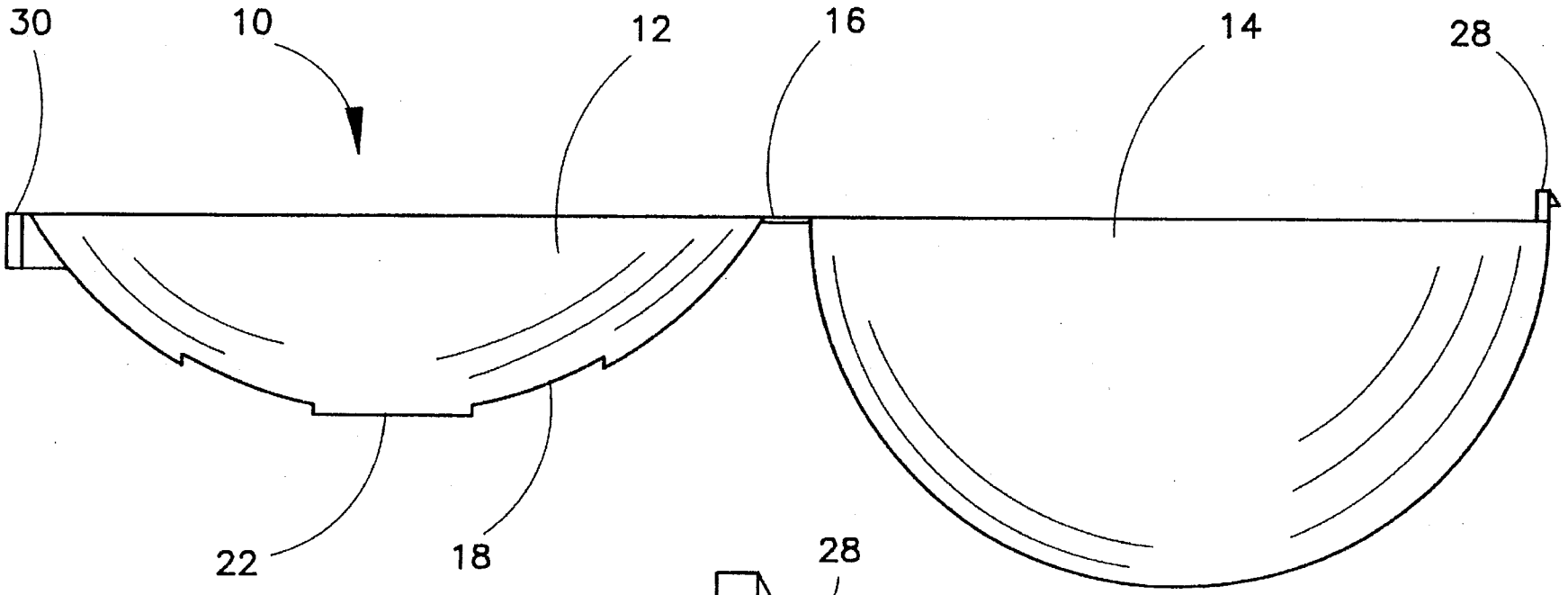
FIG. 3 is a right side elevational view thereof.
Figure 4:
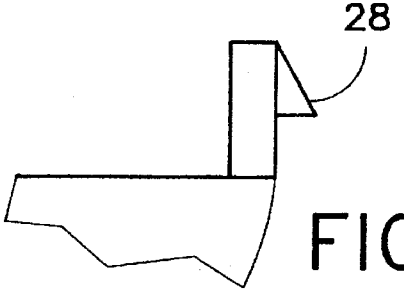
FIG. 4 is a side elevational view of a detent or latch of the toothbrush holder of FIGS. 1–3.
Figure 5:
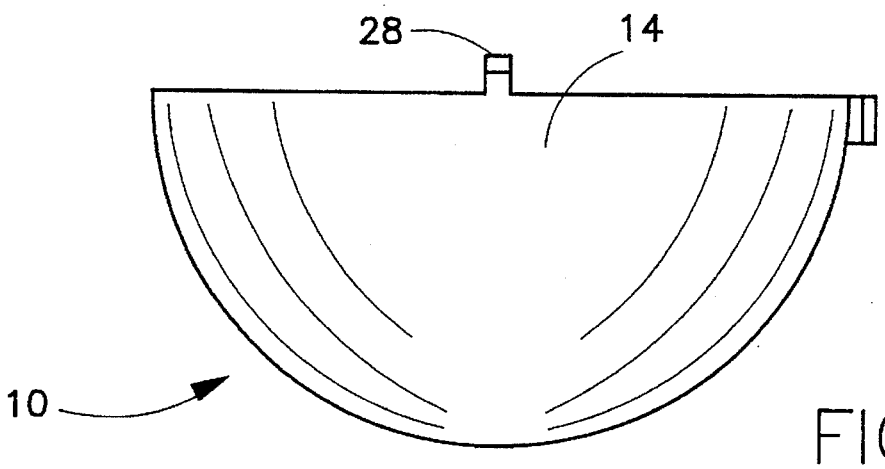
FIG. 5 is a rear elevational view of the toothbrush holder of FIGS. 1–3.
Figure 6:
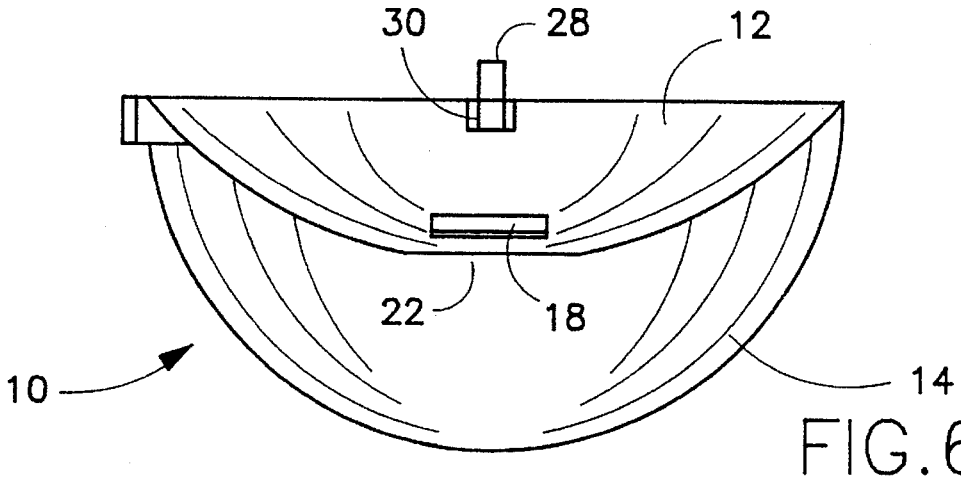
FIG. 6 is a front elevational view thereof.
Figure 7:
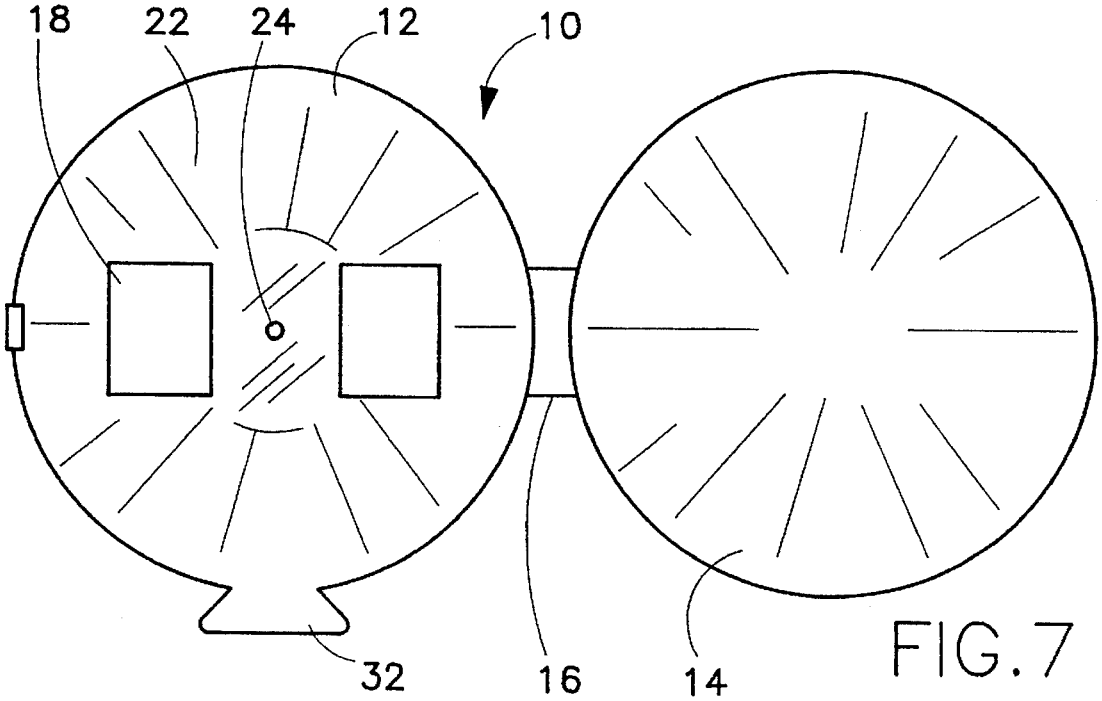
FIG. 7 is a bottom plan view thereof.
Figure 8:
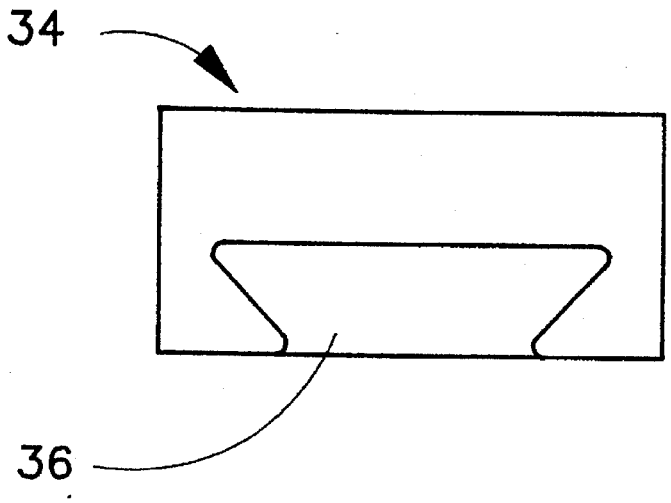
FIG. 8 is a top plan view of an attachment or coupling element on the toothbrush holder of FIGS. 1–3 and 5–7.
Figure 9:
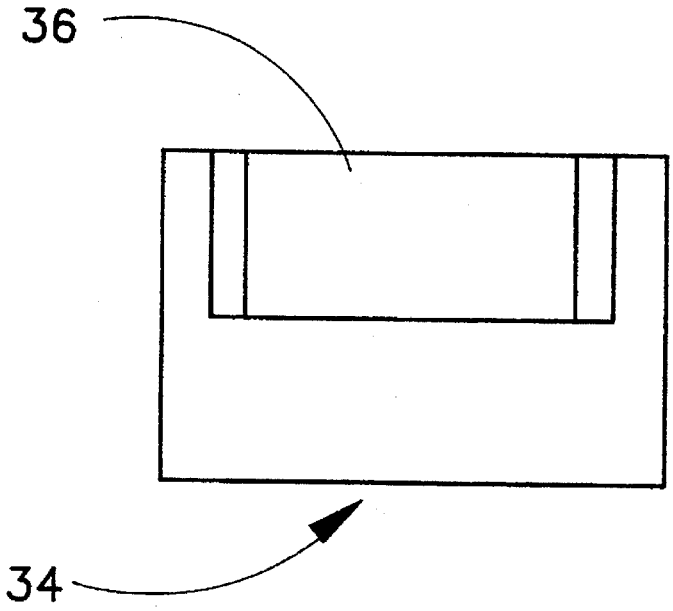
FIG. 9 is a side elevational view of the attachment or coupling element of FIG. 8.

As illustrated in the drawings, a toothbrush holder 10 comprises a generally cup-shaped support member 12 and a generally cup-shaped lid member 14 attached to one another via a hinge section 16. Support member 12 is provided with at least one and preferably a plurality of rectangular apertures 18 each traversable by a respective toothbrush handle (not shown). After use of a toothbrush, a handle of the brush is inserted generally vertically downwardly through a respective aperture 18. The bristles (not shown) of the toothbrush rest on an inner, concave surface 20 of support member 12.

Support member 12 is formed with a flattened lower, central section 22 which in turn is provided centrally with a hole 24 for enabling drainage of fluid from support member 12 and for enhancing drying air flow through the holder 10.

Lid member 14 is movably attached to support member 12 via hinge section 16 so as to be shiftable between a closure position (not shown) covering support member 12 and a toothbrush head (not shown) on support member 12 and an opened position (shown in the drawings) providing access to support member 12 and a toothbrush supported thereby.

Although it is contemplated that the drainage structure of support member 12, namely, central section 22 and hole 24, is different and spaced from each aperture 18, it is possible to drain fluid through the apertures thermselves. Of course, in that case, apertures 18 are located at lowermost points of support member 12.

It is to be noted that toothbrush holder 10 may be provided with but a single aperture 18. Alternatively, support member 12 may be formed with more than two such apertures 18. Each toothbrush-receiving aperture 18 is radially spaced from drainage hole 24 and angularly spaced from the other apertures about an axis 26 of support member 12.

Lid member 14 and support member 12 may approximate spherical sections.

A snap-lock detent or latch 28 is provided on lid member 14 for cooperating with a recess 30 on support member 12 to releasably lock the lid member to the support member. Generally, it is contemplated that hinge section 16 operates as a spring to automatically open the toothbrush holder 10 upon a releasing of detent 28 from recess 30.

Toothbrush holder device further includes a toothed element 32 on support member 12 for attaching the support member to a stationary fixture (not shown) via a receptacle element 34. Receptacle element 34 is provided with a recess 36 for the removable insertion of toothed element 32 and is attachable, for example, via an adhesive layer (not shown) or hook and loop fasteners (VELCRO) to tiles or other bathroom surfaces.

In toothbrush holder 10, lid member 14 serves to create an enclosure for toothbrush bristles, thereby shielding the bristles from the spray which is incidental to teeth cleaning and from other air-borne microorganisms. Toothbrush holder 10 is disposable and accordingly the entire holder may be removed from a bathroom fixture for replacement by a new, sterile, holder.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are profferred by way of example to facilitate comprehension of the invention and should not be construed to limit the scope thereof.

What is claimed is:

1. A toothbrush holder device comprising:

a generally hemispherical support member having a hemispherically concave inner surface tapering down to a drainage hole in a lowermost part of said support member, said support member being provided with a plurality of apertures each traversable by a toothbrush handle, said apertures traversing said inner surface, said apertures being upwardly spaced from said hole and angularly spaced from one another about an axis of said support member; and a lid member movably attached to said support member so as to be shiftable between a closure position covering said support member and a toothbrush head on said support member and an opened position providing access to said support member and a toothbrush supported thereby.

2. The device defined in claim 1, wherein said lid member is hingedly secured to said support member.

3. The device defined in claim 1, further comprising means on said support member and said lid member for releasably locking said lid member to said support member.

4. The device defined in claim 1, further comprising means on said support member for attaching said support member to a stationary fixture.

5. The device defined in claim 3, further comprising a plate mounted to the stationary fixture, said plate being provided with a recess, said means for attaching including a tooth insertable into said recess.

* * * * *